US005800634A

United States Patent [19]

McWilliams et al.

[11] Patent Number: 5,800,634

[45] Date of Patent: Sep. 1, 1998

[54] METHOD OF MANUFACTURING AN ELECTRICAL RESISTANCE HEATING MEANS

[75] Inventors: Joseph Anthony McWilliams; Ali Paybarah, both of Droitwich, United Kingdom

[73] Assignee: Ceramaspeed Limited, United Kingdom

[21] Appl. No.: 729,960

[22] Filed: Oct. 15, 1996

Related U.S. Application Data

[63] Continuation of PCT/GB95/00785 Apr. 6, 1995.

[30] Foreign Application Priority Data

Apr. 16, 1994 [GB] United Kingdom ..... 9407596
Feb. 16, 1995 [GB] United Kingdom ..... 9503019

[51] Int. Cl.[6] ..... C22C 8/10

[52] U.S. Cl. ..... 148/285; 148/287; 148/276; 148/281

[58] Field of Search ..... 148/285, 276, 148/281, 287

[56] References Cited

U.S. PATENT DOCUMENTS

| | | | |
|---|---|---|---|
| 4,312,682 | 1/1982 | Herchenroeder | 148/285 |
| 4,414,023 | 11/1983 | Aggen et al. . | |
| 4,439,248 | 3/1984 | Herchenroeder et al. | 148/285 |
| 4,615,747 | 10/1986 | Kato et al. . | |
| 4,742,038 | 5/1988 | Matsumoto . | |
| 4,885,269 | 12/1989 | Cyron | 502/439 |
| 4,969,960 | 11/1990 | Lehnert et al. | 148/284 |
| 5,294,586 | 3/1994 | Sigler | 148/285 |
| 5,531,837 | 7/1996 | Ohashi et al. | 148/285 |

FOREIGN PATENT DOCUMENTS

| | | | |
|---|---|---|---|
| 0303354 | 2/1989 | European Pat. Off. . | |
| 0327831 | 8/1989 | European Pat. Off. . | |
| 0390321 | 10/1990 | European Pat. Off. . | |
| 0510950 | 10/1992 | European Pat. Off. . | |
| 0 576 067 | 12/1993 | European Pat. Off. | 148/285 |
| 9114930 | 2/1992 | Germany . | |
| 4308065 | 10/1992 | Japan . | |
| 1165828 | 10/1969 | United Kingdom . | |
| 1238701 | 7/1971 | United Kingdom . | |
| 1323782 | 7/1973 | United Kingdom . | |
| 2114603 | 8/1983 | United Kingdom . | |

OTHER PUBLICATIONS

Examiner's Report (UK) Application No. GB 9407596.7, filed Apr. 16, 1994.

International Search Report PCT/GB95/00785 filed Jun. 4, 1995.

Elektrowarme International vol. 47 No. B3, Jun. 1989 pp. 136–146.

*Primary Examiner*—John Sheehan

*Attorney, Agent, or Firm*—Ira S. Dorman

[57] ABSTRACT

An electrical resistance heating element is made from an electrical resistance material having the following composition in weight percent:

| | |
|---|---|
| Group A: | |
| aluminium | 3–8 |
| yttrium, zirconium, hafnium and/or one or more rare earth elements | 0–0.45 |
| Group B: | |
| chromium | 12–30 |
| iron and/or nickel and/or cobalt | balance |

The electrical resistance material is arranged in an atmosphere having a potential for oxidation such as to permit oxidation of the constituent(s) from Group A and to inhibit oxidation of the constituents from Group B. The resistance material is then heated in the atmosphere to a temperature in the range from 800° C. to a temperature below its melting point so as to oxidize the constituent(s) of Group A at the surface and to form a surface layer consisting essentially of continuous unified oxide of the constituent(s) of Group A.

37 Claims, 4 Drawing Sheets

METHOD OF MANUFACTURING AN ELECTRICAL RESISTANCE HEATING MEANS

CROSS REFERENCE TO RELATED APPLICATION

This application is a continuation of copending International Application No. PCT/GB95/00785, filed Apr. 6, 1995.

BACKGROUND OF THE INVENTION

The present invention relates to a method of manufacturing an electrical resistance heating means, for example for use as a heating element in a radiant electric heater such as for use in a smooth top glass-ceramic cooking appliance.

It is well known to use for heating elements in radiant electric heaters for cooking appliances alloys having, as major constituents, chromium and aluminium together with iron and/or nickel and/or cobalt. The heating elements when connected to an electricity supply are electrically self-heated to radiance at operating temperatures which may be of the order of 900° C. to 1150° C. During such high temperature operation in air, the aluminium present in the alloy forms a protective aluminium oxide layer, for example of the order of 5 to 15 microns in thickness, on the surface of the alloy. Other constituents of the alloy, such as iron and chromium, present at the exposed surface of the alloy, also oxidise and the aluminium oxide may not, therefore, form a continuous or undisrupted layer over the entire surface of the alloy. Furthermore, mixed alumina phases primarily form on the surface of the alloy under these conditions, for example a mixture of alpha, beta, gamma and other transition alumina phases, plus some other non-alumina phases. The resulting surface layer exhibits significant permeability to atmospheric oxygen and is consequently not fully protective. Thus, during continuing high temperature operation of the alloy as a heating element, permeating atmospheric oxygen continuously oxidises aluminium which diffuses from the body of the alloy to the surface. A mainly aluminium oxide layer of increasing thickness forms at the surface of the alloy, with gradual depletion of aluminium in the body of the alloy.

The life of a heating element largely depends on the rate of oxidation and therefore the rate of growth of the protective aluminium oxide layer. A reduction in the permeability of the oxide layer would therefore result in an increase in the life of the element.

The presence in the surface of the alloy of oxides of constituents other than aluminium, such as iron oxide and chromium oxide, affects the integrity of the aluminium oxide layer and may result in disruption and localised flaking off of aluminium oxide, particularly during thermal cycling conditions of repeated heating and cooling of the alloy which is usual in heating element applications, with loss of protection to the resulting exposed regions of the alloy. Flaking may be reduced by addition of small percentages, in the range from 0.01 to 0.45 weight percent of active elements such as yttrium or rare earth elements which change the aluminium oxide crystal structure from platelet to columnar form.

When all of the aluminium in the alloy heating element has been oxidised, oxidation of the other constituents of the alloy, such as iron and chromium, takes over and failure of the heating element ultimately occurs. In the case of relatively thick, for example 800 microns or more, wire heating elements an adequately long life, for example in excess of 5000 hours, can readily be obtained. However, problems have arisen with thin heating elements such as thin wire and particularly with heating elements in the form of a thin strip or ribbon of the alloy which may, for example, be supported on edge on an insulating base. Such a strip or ribbon may, for example, be from 20 to 200 microns in thickness. If such a strip or ribbon is operated as a radiant heating element, a thick layer of aluminium oxide is formed on the surface, as described above. Because the strip or ribbon is thin, the time taken for all the aluminium to diffuse to the surface and oxidise is shorter than for thicker alloy elements. Furthermore, the thermal expansion coefficient of the aluminium oxide layer is considerably different from that of the underlying alloy material and the thickness of the oxide layer may represent a significant proportion of the total thickness of the strip or ribbon. Consequently, during thermal cycling which occurs when the heating element is being operated, mechanical stresses occur which result in progressive permanent deformation of the strip or ribbon. This leads to certain regions of the strip or ribbon having reduced thickness of electrically conducting material compared with other regions. Such regions of reduced thickness may reach a higher temperature than the remainder of the strip or ribbon when the strip or ribbon is electrically connected and operating as a heating element. Failure of the heating element subsequently occurs at one or more of these regions of reduced thickness, for example as a result of stress corrosion cracking.

One apparent method of improving the life of such a heating element would appear to be to increase the aluminium content of the alloy. However, as the aluminium content rises, the alloy becomes progressively less ductile and more difficult to work. This problem imposes a limit of about 8 percent by weight of aluminium in the alloy, although in practice the aluminium content is usually somewhat less than 8 percent.

SUMMARY OF THE INVENTION

It is an object of the present invention to provide a method of manufacturing an aluminium alloy heating element which gives rise in use to a reduced rate of loss of aluminium from the body of the alloy and consequently results in increased element life.

According to the present invention there is provided a method of manufacturing an electrical resistance heating means comprising the steps of:

providing an electrical resistance material comprising an alloy having the following composition in weight percent:

| | |
|---|---|
| Group A: | |
| aluminium | 3–8 |
| yttrium, zirconium, hafnium and/or one or more rare earth elements | 0–0.45 |
| Group B: | |
| chromium | 12–30 |
| iron and/or nickel and/or cobalt | balance |

providing an atmosphere around the electrical resistance material, the potential for oxidation of the atmosphere being such as to permit oxidation of the constituent(s) from Group A and to inhibit oxidation of the constituents from Group B; and heating the electrical resistance material in the atmosphere to a temperature in the range from 800° C. to a temperature below the melting point of the alloy so as to oxidise the constituent(s) of Group A at the surface of the alloy whereby to form a surface layer consisting essentially of continuous unified oxide of the constituent(s) of Group A.

We have found that the provision according to the invention of a surface oxide layer which in practice consists substantially of alumina gives rise to a surface layer which has low permeability to air or other oxidising atmospheres and which provides significant resistance to subsequent oxidation of the aluminium in the underlying body of the alloy and therefore gives rise to an unexpectedly slow rate of increase in thickness of the surface layer.

The alloy need not contain an active element and in this case the alloy may have the following composition in weight percent:

| | |
|---|---|
| Group A: | |
| aluminium | 3–8<br>preferably 4.5–6 |
| Group B: | |
| chromium | 12–30<br>preferably 19–23 |
| iron and/or nickel and/or cobalt | balance |

However, where the alloy does contain an active element the alloy may have the following composition in weight percent:

| | |
|---|---|
| Group A: | |
| aluminium | 3–8<br>preferably 4.5–6 |
| yttrium, zirconium, hafnium and/or one or more rare earth elements | 0.01–0.45<br>preferably 0.025–0.4 |
| Group B: | |
| chromium | 12–30<br>preferably 19–23 |
| iron and/or nickel and/or cobalt | balance |

The one or more rare earth elements may comprise lanthanum and/or cerium, preferably lanthanum. Where the rare earth elements comprise lanthanum and cerium the combined content of these elements in the alloy may be in the range from 0.025 to 0.07 percent by weight. Preferably the lanthanum content is in the range from 0.005 to 0.02 percent by weight and the cerium content is in the range from 0.02 to 0.05 percent by weight. Where the rare earth element comprises lanthanum, the lanthanum content of the alloy may be in the range from 0.06 to 0.15 percent by weight.

Where the active element comprises zirconium, the zirconium content of the alloy may be in the range from 0.1 to 0.4 percent by weight.

The thickness of the surface layer should be less than about 2 microns, preferably less than about 1 micron and ideally about 0.3 to 0.5 microns. By restricting the surface layer to a thickness which is small relative to the thickness or diameter of the electrical resistance material, mechanical stress deformation of the resulting heating means is minimised when it is subjected to thermal cycling.

The atmosphere in which the electrical resistance material is heated may comprise water vapour, a hydrogen/inert gas mixture, carbon dioxide or carbon monoxide. The inert gas may be, for example, helium, neon, argon, krypton or xenon.

The temperature and duration of the heating phase may be interdependent, the higher the temperature the shorter the duration.

When the atmosphere comprises a hydrogen/inert gas mixture containing, for example, about 4 percent by volume hydrogen the heating may be effected at a temperature from 1000° C. to 1400° C., preferably from 1050° C. to 1250° C. For example, the electrical resistance material may be heated in the atmosphere to a temperature of about 1200° C. for about one hour.

When, in a preferred embodiment, the atmosphere comprises water vapour, the electrical resistance material may be heated in the atmosphere at a temperature of about 900° C. to about 1300° C. for about 2 to about 8 minutes. A temperature of about 1000° C. is preferred to a temperature of 900° C. and a temperature of about 1100° C. is generally preferred to a temperature of 1000° C. Where the alloy contains lanthanum predominantly as the active element, a temperature of about 1200° C. is generally preferred over lower temperatures, while if the alloy contains zirconium a temperature of about 1300° C. is generally preferred over lower temperatures.

Alternatively, where the atmosphere comprises water vapour, the electrical resistance material may be heated in the atmosphere at a temperature of about 1200° C. for about 8 minutes. With a temperature of about 1360° C. to 1400° C. the duration is about 5 minutes, and with a temperature of about 1450° C. to 1475° C. the duration is about 2 minutes. The aluminium oxide may be substantially in the form of alpha alumina. Alpha alumina is the highest density form of alumina and has a lower permeability to air and other oxidising atmospheres than that of the mixed alumina crystals formed in the prior art.

Preferably the electrical resistance material is monolithic, for example rolled or drawn from an ingot, but it may alternatively be made of sintered material.

As a result of the manufacturing process, the surface layer has low permeability to air or other oxidising atmosphere.

BRIEF DESCRIPTION OF THE DRAWINGS

The invention is now described by way of example with reference to the accompanying drawings, in which.

DETAILED DESCRIPTION OF THE ILLUSTRATED EMBODIMENTS

Figure 1:
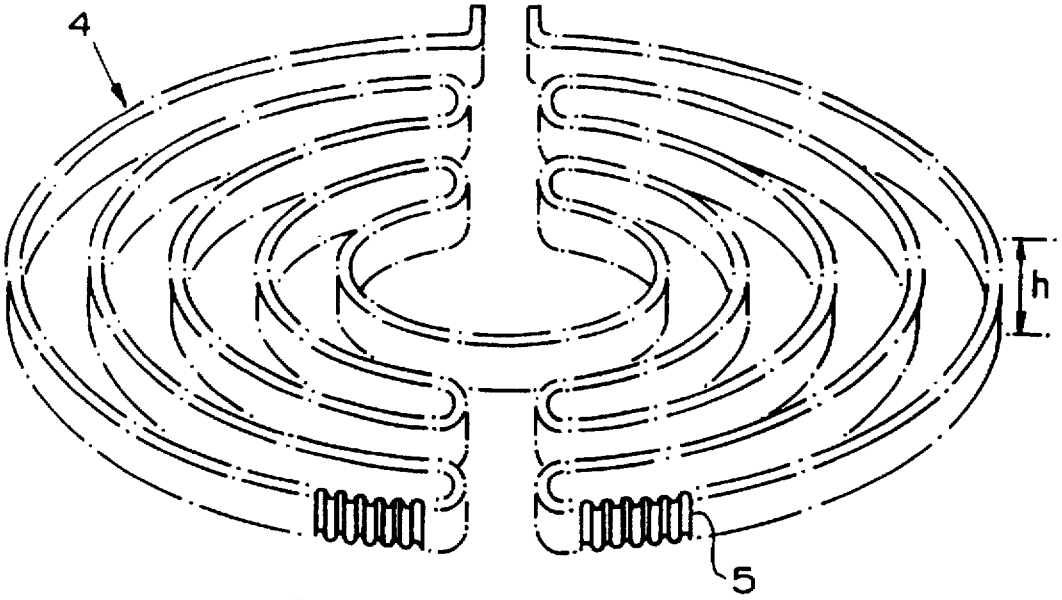
FIG. 1 is a perspective view of one embodiment of a heating element for a radiant electric heater.

As shown in FIG. 1, a heating element 4 for use as a heating element in a radiant heater for a glass-ceramic top cooking appliance is produced by corrugating a strip 5 and then bending it into the shape required for the element.

Figure 3:
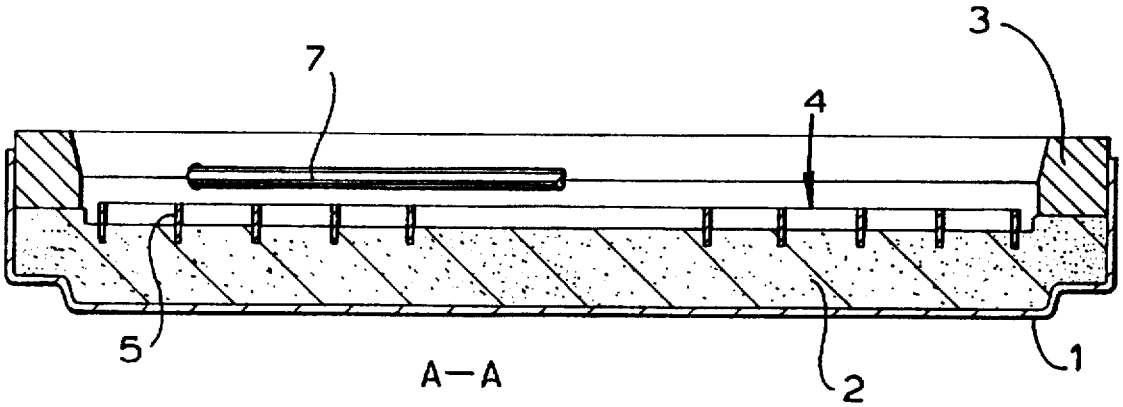
FIG. 3 is a sectional view of the radiant electric heater of FIG. 2.
Figure 2:
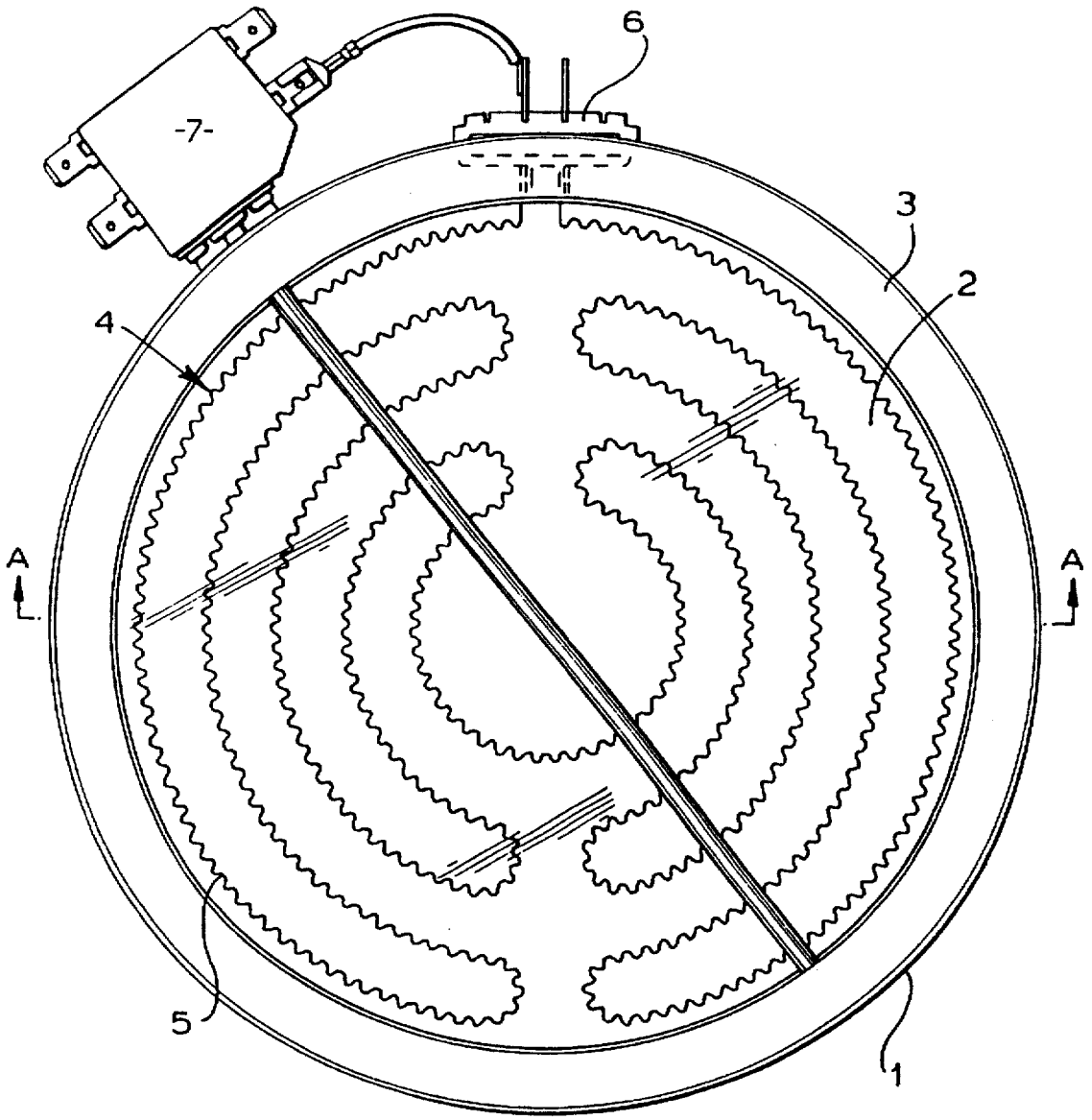
FIG. 2 is a plan view of a radiant electric heater incorporating the heating element of FIG. 1.

Referring to FIGS. 2 and 3, the heating element 4 is secured to a base layer 2 of thermal and electrical insulation material, preferably microporous thermal insulation material, in a metal dish 1. The element 4 is suitably secured by embedding the strip 5 from which it is made to part of its height in the base layer 2. If desired, the strip 5 of the element 4 may be profiled along that edge thereof which is embedded in the insulation material, for example by providing downwardly-extending integral spaced-apart tabs (not shown) which are embedded in the insulation material of the base layer 2.

A terminal connector 6 is provided for electrically connecting the heating element 4 to an electrical supply, for operation thereof.

Against the side of the dish 1 is located a peripheral wall 3 of thermal insulation material whose top surface is arranged in use to contact the underside of a glass-ceramic cooktop in a cooking appliance.

A well-known form of thermal cut-out device 7 is provided, extending over the heating element 4, to switch off the heating element to prevent over-heating when the heater is installed and operating in a cooking appliance.

By way of example, the strip 5 forming the heating element 4 has a height, h, of from 1.5 to 6 mm and a thickness from 20 to 200 microns.

Figure 4:
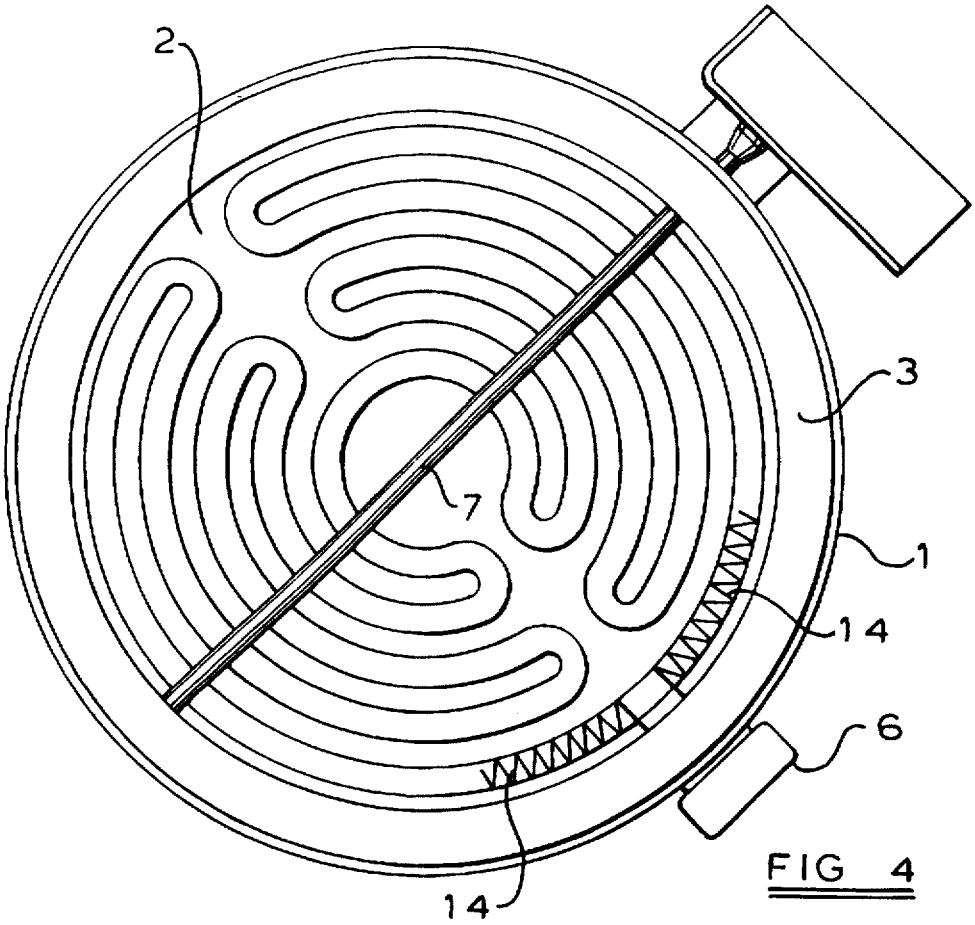
FIG. 4 is a plan view of a radiant electric heater incorporating an alternative form of heating element.
Figure 5:
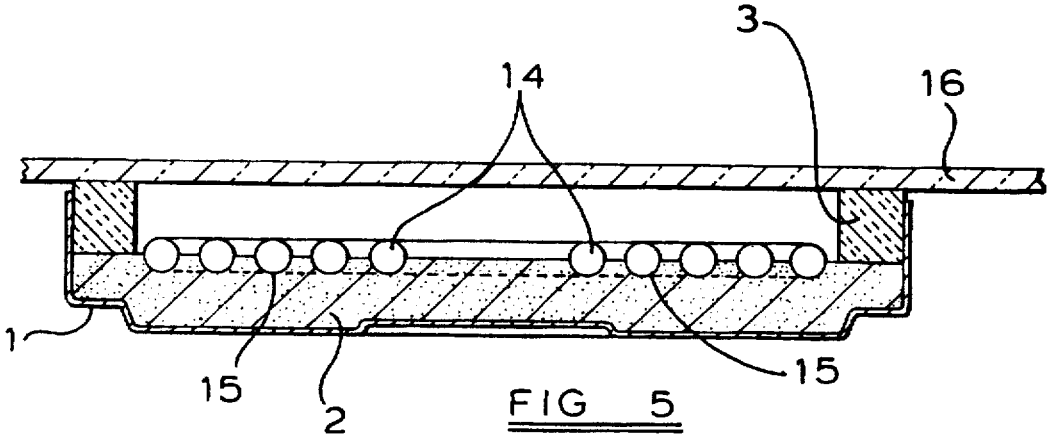
FIG. 5 is a sectional view of the radiant electric heater of FIG. 4.

Referring to FIGS. 4 and 5, the corrugated strip form of heating element of FIG. 1 is replaced by a helically wound coil heating element 14 which is secured to the base layer 2 in the metal dish 1. The heating element 14 is secured in grooves 15 formed in the base layer 2 by any suitable means such as metal staples (not shown).

The terminal connector 6 permits electrical connection of the heating element 14 to an electrical supply for operation thereof.

The peripheral wall 3 is located against the side of the dish 1 and in use the top surface of the peripheral wall contacts the underside of the glass-ceramic cooktop 16 of a cooking appliance.

Thermal cut-out 7 extends over the heating element 14 to switch off the heating element in order to prevent overheating when the heater is installed and operating in a cooking appliance.

The wire forming the heating element 14 may have any convenient diameter, for example from 250 to 750 microns or more.

EXAMPLES

Embodiments of the invention are now described by way of example.

Example 1

A sample of a resistance element in the form of a thin strip or ribbon having a thickness of, for example, from 20 to 200 microns, was placed inside a furnace enclosure at about room temperature. The resistance element was made of an alloy having the following composition in weight percent:

| | |
|---|---|
| aluminium | 4.5–6 |
| lanthanum | 0.06–0.15 |
| chromium | 19–22 |
| iron | balance. |

A gas mixture of hydrogen and argon, comprising about 4 percent by volume of hydrogen, was passed through the furnace such that air was purged from the furnace. An amount of oxygen was maintained in the furnace atmosphere, for example as an impurity in the hydrogen/argon gas mixture or present in traces of water vapour or carbon dioxide mixed with the hydrogen/argon gas in the furnace enclosure or introduced into the atmosphere.

The temperature within the furnace was raised to about 1200° C. and the strip maintained therein for about one hour, then removed. During this treatment process a dense, substantially continuous unified layer of alpha alumina crystals formed on the strip from aluminium in the alloy material of the strip, but oxidation of iron and chromium present at the surface of the alloy material of the strip was inhibited.

The resulting layer of alpha alumina was thin, for example about 0.5 microns, relative to the thickness of the strip and adhered strongly to the underlying alloy material of the strip.

A sample of the resulting treated strip was connected to an electrical power source and electrically self-heated cyclically between about room temperature and 1150° C. in air until failure occurred. It was found that the treated sample endured the temperature cycling test for about twice as long as an untreated control sample, before failing.

The heating element need not be in the form of a strip or ribbon and can alternatively be in the form of wire having a diameter in the range, for example, from 250 to 750 microns or more.

Example 2

Figure 6:
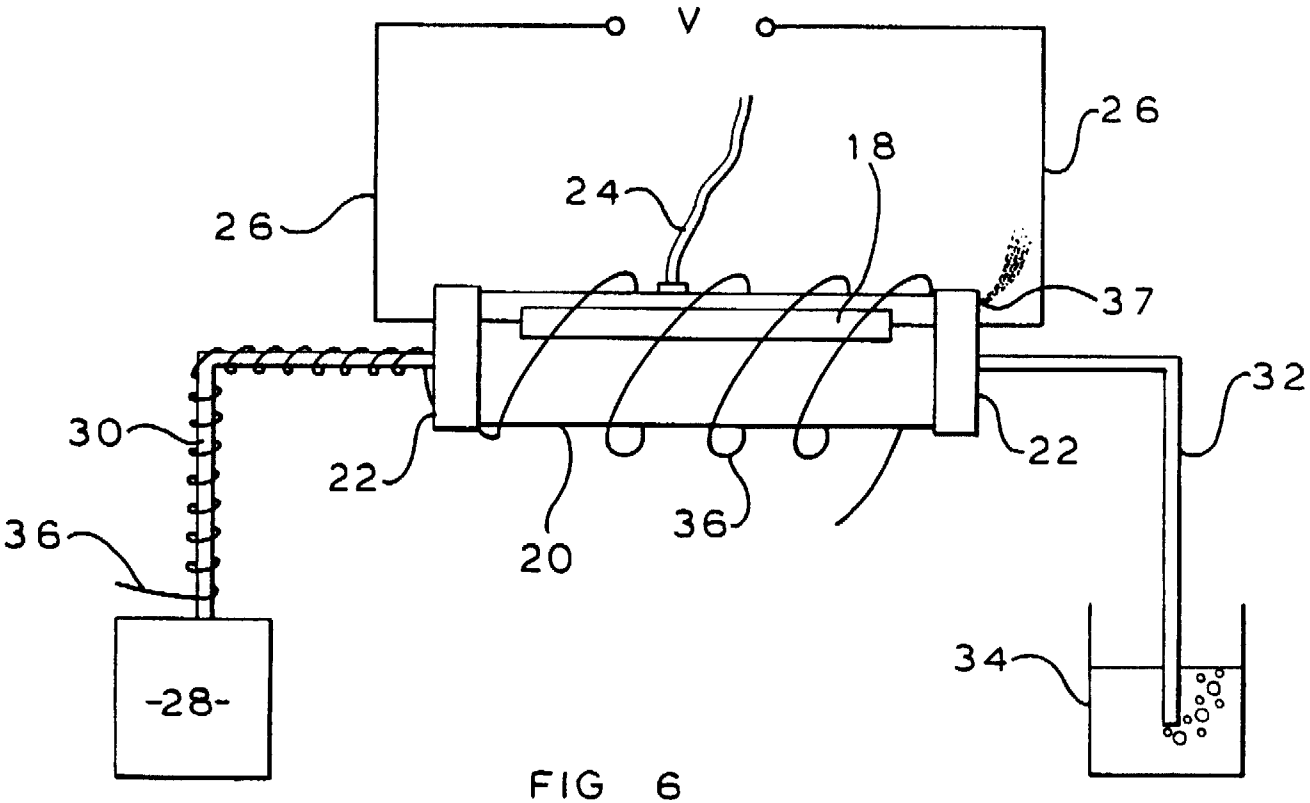
FIG. 6 is a diagrammatic illustration of one embodiment of a treatment apparatus for effecting the method according to the present invention.

As illustrated in FIG. 6, a sample 18 of a resistance element in the form of a thin strip or ribbon having a thickness of about 50 microns was located inside a treatment enclosure 20 at about room temperature. The treatment enclosure 20 was in the form of a quartz tube provided with metal end caps 22, the caps being provided with a layer of thermal insulating material on the inside surface thereof. A thermocouple 24 was positioned externally of the treatment enclosure for determining the temperature of the surface of the enclosure.

The resistance element was made of an alloy having the following composition in weight percent:

| | |
|---|---|
| aluminium | 4.5–6 |
| lanthanum | 0.06–0.15 |
| chromium | 19–22 |
| iron | balance. |

Electrical lead wires 26 were connected to the ends of the sample 18 through the end caps 22 for connection to a voltage source V.

Water vapour from a known form of water vapour (steam) generator 28 was passed into the treatment enclosure 20 through a quartz tube 30 so as to thoroughly purge air from the interior of the enclosure with water vapour and to maintain the enclosure filled with water vapour. Purging of the air by the water vapour was confirmed by conducting outflowing air along a quartz tube 32 and into a water bath 34 such that bubbles indicated a flow of air out of the treatment enclosure. Bubbling of air ceased when full purging of air had occurred. An electrical heating element in the form of an electrical heating tape 36 was wrapped around the quartz tube 30 and around the outside of the enclosure 20 to heat the tube 30 and the enclosure 20 to about 200° C. in order to minimise the risk of condensation of the water vapour.

The sample 18 was then electrically self-heated in the water vapour atmosphere to a temperature of about 1200° C. for 8 minutes by passing an electrical current through the sample, the temperature being such as to cause partial dissociation of the water vapour into oxygen for oxidation of the aluminium and lanthanum and into hydrogen to inhibit oxidation of the chromium and iron. During the treatment, positive pressure of water vapour in the enclosure was ensured and indicated by a visible stream of steam issuing from a small hole 37 provided at the end of the enclosure 20. After the treatment the sample was removed from the enclosure and was found to have a substantially continuous, unified, dense, thin layer of alumina on its surface formed from aluminium in the alloy material of the strip, but oxidation of iron and chromium present at the surface of the alloy material of the strip was inhibited.

The resulting layer of alumina was thin, for example about 0.5 microns, relative to the thickness of the strip and adhered strongly to the underlying alloy material of the strip.

The treatment was repeated on four further samples of alloy material of the same composition, with the time and temperature being varied in accordance with Table 1 below:

TABLE 1

| | | | | |
|---|---|---|---|---|
| Temperature of sample (°C.) | 1360 | 1400 | 1450 | 1475 |
| Time of treatment (minutes) | 5 | 5 | 2 | 2 |
| Thickness of alumina layer formed (microns) | 0.5 | 0.6 | 0.6 | 1.0 |

The treated samples were tested alongside a control sample of the same strip material which had not been treated as described above.

All the samples were connected to an electrical power source and electrically self-heated cyclically between about room temperature and 1150° C. in air until failure occurred. It was found that the treated samples endured the temperature cycling test for about twice as long as the untreated control sample, before failing.

The heating element need not be in the form of a strip or ribbon and can alternatively be in the form of wire having a diameter in the range, for example, from 250 to 750 microns or more.

The method of Example 2 has been applied to other alloy compositions. One alloy used has the following composition in weight percent:

| | |
|---|---|
| aluminium | 5–6 |
| zirconium | 0.1–0.4 |
| chromium | 21–23 |
| iron | balance |

Another alloy has the following composition in weight percent:

| | |
|---|---|
| aluminium | 5–6 |
| cerium | 0.02–0.05 |
| lanthanum | 0.005–0.02 |
| chromium | 19–21 |
| iron | balance |

We have also used an alloy having the following composition in weight percent:

| | |
|---|---|
| aluminium | 4.5–5 |
| chromium | 19.5–21.5 |
| iron | balance |

In each case we have treated samples of the material, either in ribbon or wire form, in accordance with the method of Example 2 at temperatures of 1000° C., 1100° C., 1200° C. and 1300° C. for 2 minutes and for 8 minutes.

In each case a thin layer of alumina was formed on the material.

All the samples were connected to an electrical power source and electrically self-heated cyclically between about room temperature and 1150° C. It was found that all samples withstood the temperature cycling test better than an untreated control sample inasmuch as the thickness of the oxide layer increased more slowly. However, among the treated samples it was found that in general those samples treated at 1100° C. withstood the test better than those treated at 1000° C. Where the alloy contained lanthanum predominantly as the active element, the samples treated at 1200° C. withstood the test better than those treated at lower temperatures, while, where the alloy contained zirconium, the samples treated at 1300° C. withstood the test better than those treated at lower temperatures. This was in general the case irrespective of whether the samples were treated for 2 minutes or for 8 minutes.

Thus, where the samples are treated in water vapour, an extended treatment period is unnecessary.

We claim:

1. A method of manufacturing an electrical resistance heating means comprising the steps of:

providing an electrical resistance material comprising an alloy having the following composition in weight percent:

| | |
|---|---|
| Group A: | |
| aluminum | 3–8 |
| a metal selected from a first class consisting of yttrium, zirconium, hafnium, at least one rare earth element, and mixtures thereof | 0–0.45 |
| Group B: | |
| chromium | 12–30 |
| a metal selected from a second class consisting of iron, nickel, cobalt, and mixtures thereof | balance |

and heat treating the electrical resistance material in an enclosure in a single stage, said stage consisting of the steps of:

a. supplying an atmosphere consisting solely of water vapour to the enclosure such that the heat treatment is effected in an atmosphere consisting essentially of water vapour, the potential for oxidation of the atmosphere being such as to permit oxidation of the constituents(s) from Group A and to inhibit oxidation of the constituents from Group B; and b. heating the electrical resistance material in the supplied atmosphere to a temperature in the range from 800° C. to a temperature below the melting point of the alloy so as to oxidize the constituents(s) of Group A at the surface of the alloy whereby to form a surface layer consisting essentially of continuous unified oxide of the constituents(s) of Group A.

2. The method according to claim 1 wherein the alloy contains at least 0.01 weight percent of the metal of said first class.

3. The method of claim 2 wherein the alloy contains 4.5 to 6 weight percent of aluminium, 0.025 to 0.4 weight percent of at least one metal of said first class, and 19 to 23 weight percent of chromium.

4. A method according to claim 1, wherein said at least one rare earth element is selected from the group consisting of lanthanum and mixtures thereof.

5. A method according to claim 4, wherein the rare earth elements comprise lanthanum and cerium and the combined content of such elements in the alloy is in the range from 0.025 to 0.07 percent by weight.

6. A method according to claim 5, wherein the lanthanum content is in the range from 0.005 to 0.02 percent by weight.

7. A method according to claim 5, wherein the cerium content is in the range from 0.02 to 0.05 percent by weight.

8. A method according to claim 4, wherein said rare earth element comprises lanthanum.

9. A method according to claim 8, wherein the lanthanum content of the alloy is in the range from 0.06 to 0.15 percent by weight.

10. A method according to claim 1, wherein the alloy contains zirconium in an amount from 0.1 to 0.4 percent by weight.

11. The method according to claim 1 wherein the alloy is devoid of any metal of said first class.

12. The method according to claim 1 wherein the alloy contains 4.5 to 6 weight percent of aluminium and 19 to 23 weight percent of chromium, and is devoid of any metal of said first class.

13. A method according to claim 1, wherein the electrical resistance material is heated in said sampled atmosphere to produce a surface layer having a thickness less than about 2 microns.

14. A method according to claim 13, wherein the electrical resistance material is heated in said sampled atmosphere to produce a surface layer having a thickness less than about 1 micron.

15. A method according to claim 14, wherein the electrical resistance material is heated in said sampled atmosphere to produce a surface layer having a thickness of about 0.3 to 0.5 microns.

16. A method according to claim 1, wherein the heating is effected at a temperature from 900° C. to about 1475° C.

17. A method according to claim 16, wherein the heating is effected at a temperature from 900°C. to about 1300° C.

18. A method according to claim 16, wherein the heating is effected at a temperature of at least about 1000° C.

19. A method according to claim 16, wherein the heating is effected at a temperature of at least about 1100° C.

20. A method according to claim 16, wherein the alloy contains lanthanum predominantly as the active element and the heating is effected at a temperature of at least about 1200° C.

21. A method according to claim 16, wherein the alloy contains zirconium and the heating is effected at a temperature of about 1300° C.

22. A method according to claim 16, wherein the electrical resistance material is heated in said sampled atmosphere for about 2 to about 8 minutes.

23. A method according to claim 16, wherein the electrical resistance material is heated in said sampled atmosphere at a temperature of about 1200° C. for about 8 minutes.

24. A method according to claim 16, wherein the electrical resistance material is heated in said sampled atmosphere at a temperature of about 1360° C. for about 5 minutes.

25. A method according to claim 16, wherein the electrical resistance material is heated in said sampled atmosphere at a temperature of about 1400° C. for about 5 minutes.

26. A method according to claim 16, wherein the electrical resistance material is heated in said sampled atmosphere at a temperature of about 1450° for about 2 minutes.

27. A method according to claim 16, wherein the electrical resistance material is heated in said sampled atmosphere at a temperature of about 1475° C. for about 2 minutes.

28. A method according to claim 16, wherein the heating of the electrical resistance material in said sampled atmosphere oxidises the aluminium of the constituent(s) of Group A to aluminium oxide substantially in the form of alpha alumina.

29. A method according to claim 1, wherein heating of the electrical resistance material in said sampled atmosphere gives rise to a surface layer having low permeability to oxidising atmospheres.

30. A method of manufacturing an electrical resistance heating means comprising the steps of:

providing an electrical resistance material comprising an alloy having the following composition in weight percent:

| | |
|---|---|
| Group A: | |
| aluminum | 3–8 |
| a metal selected from a first class consisting of yttrium, zirconium, hafnium, at least one rare earth element, and mixtures thereof | 0–0.45 |
| Group B: | |
| chromium | 12–30 |
| a metal selected from a second class consisting of iron, nickel, cobalt, and mixtures thereof | balance |

and heating treating the electrical resistance material in an enclosure in a single stage, said stage consisting of the steps of:

a. supplying an atmosphere consisting solely of water vapour to the enclosure such that the heat treatment is effected in an atmosphere consisting essentially of water vapour and at a pressure in excess of atmospheric pressure, the potential for oxidation of the atmosphere being such as to permit oxidation of the constituent(s) from Group A and to inhibit oxidation of the constituents from Group B; and b. heating the electrical resistance material in the supplied atmosphere to a temperature in the range from 800° C. to a temperature below the melting point of the alloy so as to oxidize the constituents(s) of Group A at the surface of the alloy whereby to form a surface layer consisting essentially of continuous unified oxide of the constituents(s) of Group A.

31. A method according to claim 30, wherein the electrical resistance material is heated in said supplied atmosphere to produce a surface layer having a thickness less than about 2 microns.

32. A method according to claim 30, wherein the heating is effected at a temperature from 900° C. to about 1475° C.

33. A method according to claim 32, wherein the electrical resistance material is heated in said supplied atmosphere for about 2 to about 8 minutes.

34. A method of manufacturing an electrical resistance heating means comprising the steps of:

providing an electrical resistance material comprising an alloy having the following composition in weight percent:

| | |
|---|---|
| Group A: | |
| aluminum | 3–8 |
| a metal selected from a first class consisting of yttrium, zirconium, hafnium, at least one rare earth element, and mixtures thereof | 0–0.45 |
| Group B: | |
| chromium | 12–30 |
| a metal selected from a second class consisting of iron, nickel, cobalt, and mixtures thereof | balance |

and heat treating the electrical resistance material in an enclosure, said heat treatment consisting of the steps of:

a. supplying an atmosphere consisting solely of water vapour to the enclosure prior to the heat treatment so as to purge air from the enclosure, and maintaining the supplied atmosphere therein such that the heat treatment is effected in a single stage in an atmosphere consisting essentially of water vapour, the potential for oxidation of the atmosphere being such as to permit oxidation of the constituent(s) from Group A and to inhibit oxidation of the constituents from Group B; and b. heating the electrical resistance material in the supplied atmosphere to a temperature in the range from 800° C. to a temperature below the melting point of the alloy so as to oxidize the constituent(s) of Group A at the surface of the alloy whereby to form a surface layer consisting essentially of continuous unified oxide of the constituents(s) of Group A.

35. A method according to claim 34, wherein the electrical resistance material is heated in said supplied atmosphere to produce a surface layer having a thickness less than about 2 microns.

36. A method according to claim 34, wherein the heating is effected at a temperature from 900° C. to about 1475°.

37. A method according to claim 36, wherein the electrical resistance material is heated in said supplied atmosphere for about 2 to about 8 minutes.

* * * * *

UNITED STATES PATENT AND TRADEMARK OFFICE

CERTIFICATE OF CORRECTION

PATENT NO. : 5,800,634

DATED : September 1, 1998

INVENTOR(S) : Joseph Anthony McWilliams and Ali Paybarah

It is certified that error appears in the above-indentified patent and that said Letters Patent is hereby corrected as shown below:

In the claims:

Claim 4, column 8, line 59, ", cerium," should be inserted after the word lanthanum;

Claims 13, 14, and 15, column 9, lines 15, 19, and 23, respectively; and Claims 22 through 29, column 9, lines 42, 45, 48, 51, 54, 57, 60, and 65, respectively, at each location the word "sampled" should have been "supplied."

Signed and Sealed this

Second Day of March, 1999

*Attest:*

*Attesting Officer*

Q. TODD DICKINSON

*Acting Commissioner of Patents and Trademarks*